United States Patent [19]

Goldfinch

[11] Patent Number: 4,461,562

[45] Date of Patent: Jul. 24, 1984

[54] MAGNETIC TONER APPLICATOR

[75] Inventor: Arthur L. Goldfinch, Henley Beach, Australia

[73] Assignee: Better Methods, Inc., Secaucus, N.J.

[21] Appl. No.: 437,384

[22] Filed: Oct. 28, 1982

[30] Foreign Application Priority Data

Feb. 17, 1982 [AU] Australia ..... PF2751

[51] Int. Cl.[3] ..... G03G 15/09

[52] U.S. Cl. ..... 355/3 DD; 118/657

[58] Field of Search ..... 355/3 DD, 3 R; 118/657, 118/658; 430/122

[56] References Cited

U.S. PATENT DOCUMENTS

| | | | |
|---|---|---|---|
| 3,638,614 | 2/1972 | Young et al. | 118/658 |
| 3,707,947 | 1/1973 | Richart | 118/658 |
| 3,950,089 | 4/1976 | Fraser et al. | 355/3 DD |
| 3,982,498 | 9/1976 | Wilcox | 355/3 DD |

*Primary Examiner*—R. L. Moses

*Attorney, Agent, or Firm*—Morgan, Finnegan, Pine, Foley & Lee

[57] ABSTRACT

A magnet roll for the toning of electrostatic latent images comprising a central rectangular core mounted to be rotatable about an axis through an angle of about 180° from a first to a second position and carrying face magnetized permanent magnet segments on one rectangular face thereof, and a non-magnetizable cylindrical hollow shell mounted coaxially with the core and adapted to rotate about the axis of the core to allow the face magnetized permanent magnet segments to be moved to a first position to face a member containing an electrostatic latent image on the surface thereof during toning of the electrostatic latent image but rotatable to the second position whereby a magnetic toner carried on the cylindrical hollow shell is removed from the surface of the cylindrical hollow shell in the toning position.

6 Claims, 4 Drawing Figures

MAGNETIC TONER APPLICATOR

BACKGROUND OF THE INVENTION

It is known in the arts of electrophotography and electrostatic printing to tone electrostatic latent images contained on recording member surfaces by the application thereto of electroscopic marking particles. Such electroscopic marking particles may conveniently be applied to recording member surfaces by means of magnetic applicators of various types. In the oldest so-called magnetic brush method of magnetic application of electroscopic marking particles such marking particles are admixed with iron powder or the like and carried on a magnet roller into contact with the latent image bearing recording member surface. The magnet roller used in the magnetic brush applicator normally comprises a central core containing longitudinally two active magnetic poles in a fixed and non-moving configuration, contained within a rotating non-magnetic sleeve. One magnet pole of the so-called pick-up magnet is located at an appropriate position within the sleeve to attract magnetic material thereto which is transported by the rotating sleeve to the toning area, at which area the second magnet pole causes the magnetised particles of toner carrier in conformity with the lines of force to form the so-called brush comprising chains which are substantially normal to the rotating sleeve surface. The toner particles are attracted from the brush by the electrostatic latent image on the recording member surface to deposit on such surface forming a visible image deposit thereon.

In more recently developed technology the magnetisable carrier particles are not used, and the toner itself contains sufficient magnetic material to be attracted to a magnetic roller and carried thereby. Such so-called single component magnetic toners are normally applied by means of magnet rollers containing a multiplicity of magnet poles, ranging from about 6 poles as disclosed in U.S. Pat. No. 4,142,165 of Miyakawa et al. to 12 poles as illustrated in U.S. Pat. No. 4,081,571 of Nishihama et al. Magnetic pole arrangement may be alternate north south or may contain two adjacent poles of like polarity as disclosed for instance in U.S. Pat. No. 4,122,456 of Berkowitz et al. Other multipole magnet rollers are disclosed for instance in U.S. Pat. Nos. 4,165,393 of Suzuki et al., 4,162,842 of Wu, 4,154,520 of Nishikawa, 4,142,281 of Müller, 4,121,931 of Nelson, 4,063,533 of White, 4,003,334 of Samuels et al., 3,909,258 of Kotz and 3,882,821 of Katayama et al.

Such multiple magnet rollers may be of the rotating core or rotating sleeve type, or each of the core and the sleeve may rotate at different speeds. Alternatively the core and sleeve may be fixed to each other and rotate as a unit. Most modern practice appears to be directed towards the use of a rotating sleeve with a fixed magnet core, with one of the poles aligned with the actual toning area to cause the toner particles to form chains which are normal to the sleeve surface at this position.

Prior art investigators have generally considered that it is advantageous to use multipole magnets in magnetic rollers because in such case the toner moves with a tumbling action from one pole to the next, and this is considered to be advantageous with regards toner distribution on the magnet roller at the toning position.

A disadvantage of the prior art multipole magnet rollers is the permanence of the magnetic field, which causes the roller sleeve to remain more or less covered with toner at all time. This can cause some degree of magnetic saturation of the toner particles contained on the magnet roller and in addition makes it difficult to clear the toner entirely from the magnet roller at the toning position.

The present invention overcomes these prior art disadvantages.

SUMMARY OF THE INVENTION

The magnet roller of the present invention comprises in essence a core which is normally stationary during toning, surrounded by a rotating sleeve. The core comprises a member of substantially rectangular cross-section having two long faces and two short faces. Face magnetised permanent magnets are attached to one of the long faces of the rectangular member. One pole face of the magnets is in contact with the rectangular member. The magnet roller core is thus of the single pole type. The single pole magnet core is surrounded by a cylindrical sleeve of non-megnetic material, which may be insulative or conductive as desired. The outer surface of the sleeve may be normal machined finish, such as an extruded finish, or grained or fluted as deisred. The rectangular core is preferably a magnetisable material such as steel, but may be of non-magnetic material if desired for instance to reduce weight. However, if a non-magnetic material is used for the rectangular section it should be advantageously covered with a layer of magnetic material such as soft iron or mumetal or the like. Such construction is desirable to reduce the magnetic flux density on the surface of the sleeve remote from the magnet sufficiently to prevent retention of magnetic toner particles in that area.

DESCRIPTION OF THE PREFERRED EMBODIMENT

Figure 1:
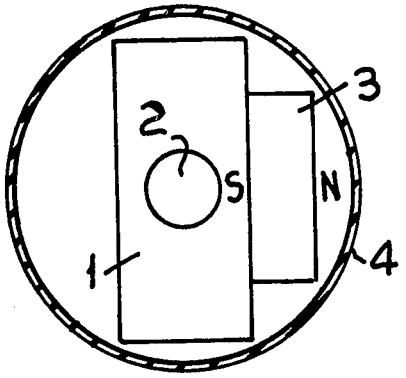
FIG. 1 shows a preferred form in sectional end elevation of the magnet roller of the present invention.

Referring now to FIG. 1 in detail, rectangular core section 1, comprising magnetisable material, is mounted on spindles 2, at each end thereof. Permanent magnet 3 face magnetised south north (S, N) at the faces marked S and N as shown is attached to one side of rectangular core section 1 in the position shown. Non-magnetic sleeve 4 is rotatably mounted around magnet 3 and core 1 assembly, concentric with spindles 2.

Figure 2:
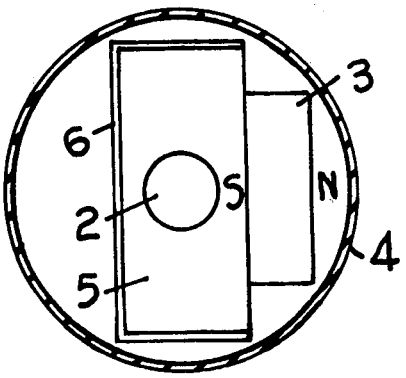
FIG. 2 shows an alternative form of the magnet roller.

FIG. 2 shows an alternative configuration for the magnet core, where rectangular core section 5 comprises non-magnetisable material such as aluminum or plastic, mounted on spindles 2 at each end. Magnetisable shield member 6, of soft iron or mu metal or the like is attached to core 5 in the position shown. Face magnetised permanent magnet 3 is attached to the face of rectangular core 5 which face is not covered by shield member 6. Non-magnetic sleeve 4 is rotatably mounted around magnet 3 and core 1 assembly concentric with spindles 2.

Figure 3:
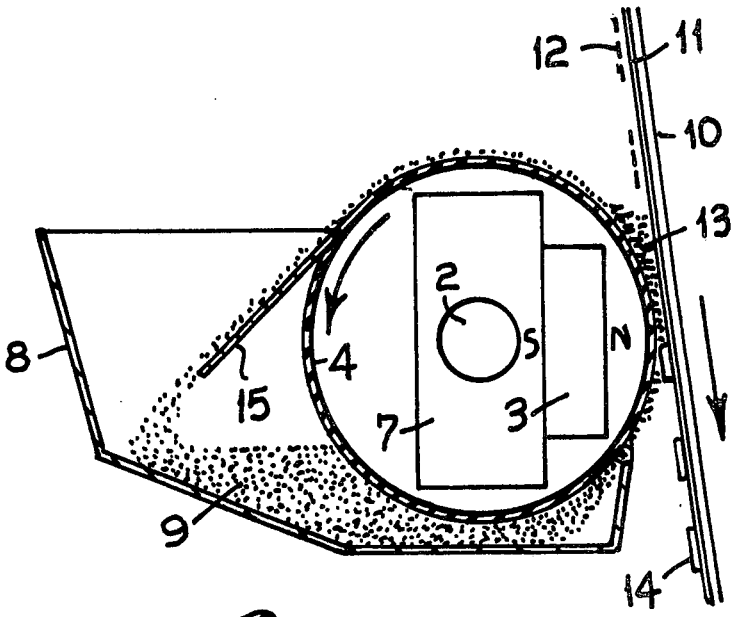
FIG. 3 shows the magnet roller in use in a toner applicator device, in the operating position.

Referring now to FIG. 3, rectangular core section 7, constructed either as shown in FIG. 1 or FIG. 2, mounted on spindles 2 and carrying permanent magnet 3 attached to one side thereof, is contained within non-magnetic sleeve 4, which is arranged to rotate in the direction shown, concentric with spindles 2. Hopper 8, containing single component magnetic electroscopic marking particles 9, is positioned as shown around non-magnetic sleeve 4. Recording member comprising base 10 and electrophotographic or electrographic layer 11 containing electrostatic latent image 12 thereon, is positioned to move in proximity to non-magnetic sleeve 4 in the direction shown. When non-magnetic sleeve 4 is rotated in the direction shown electroscopic marking particles 9 are carried thereon to a position adjacent to permanent magnet 3 to form aligned brush 13 of electroscopic marking particles 9 which are attracted to electrostatic latent image 12 to form image deposit 14. Electroscopic marking particles carried past magnet 3 on the surface of non-magnetic sleeve 4 are lifted therefrom by optional blade 15 and returned to hopper 8. Optional blade 15 would normally not be required with a smooth surfaced sleeve.

Figure 4:
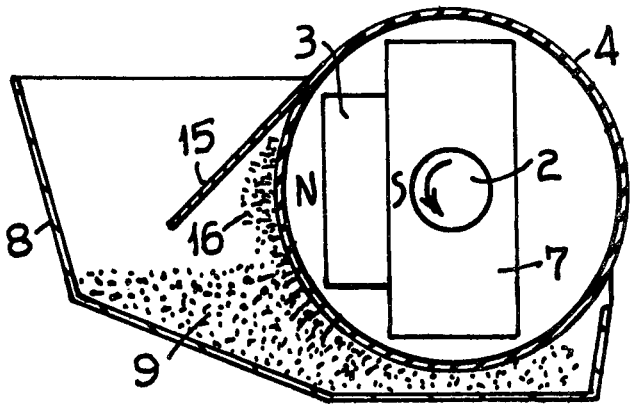
FIG. 4 shows the magnet roller in a toner applicator device in the non-operating position.

In FIG. 4, all components are as in FIG. 3, with the exception that megnet core assembly 2, 3, 7 has been rotated about 180° in the direction shown in place permanent magnet 3 below blade 15. The surface of non-magnetic sleeve 4 in the toning area is now free of electroscopic marking particles 9. An aligned brush 16 of toner particles will normally form on the sleeve in the area shown remote from the toning position.

It will be seen that the magnet roller of the present invention is of very simple construction and has the advantage that it can in effect be switched off, in that the magnetic field can be removed from the toning area for paper insertion or other purposes.

Simple permanent magnets of the barium ferrite type, face magnetised to a strength of about 1000 gauss have been found suitable for the present application, and in a magnet roller assembly of the dimensions and configuration shown in FIG. 1 the magnetic field measured in the toning area is bout 700 gauss. Surprisingly a pick-up magnet such as is disclosed in U.S. Pat. No. 3,849,161 of Klaenhammer to attract electroscopic marking particles to the sleeve is not necessary.

We have also found surprisingly that in the alternative magnet core configuration of FIG. 2 in which the rectangular core section comprises non-magnetic material the magnetisable shield members may be omitted from the core without affecting the 'switching off' feature of the assembly. This is due to the very low magnetic field strength which exists on the sleeve in areas away from the permanent magnet.

There has been described a new and useful magnet roller for toning of electrostatic latent image. It will be realised that modifications to the design and magnet strength could be made by those skilled in the art without departing from the spirit of the invention as herein described and therefore the description of these details should be read in the illustrative and not restrictive sense.

I claim:

1. A magnet roll for the toning of electrostatic latent images comprising a central rectangular core with protruding spigots mounted at the centre of each end thereof and face magnetised permanent magnet segments centrally mounted on one rectangular face thereof, surrounded by a non-magnetisable cylindrical hollow shell mounted concentrically with said spigots and adapted to rotate about said spigots, characterised by said rectangular core with said face magnetised permanent magnet segments being rotatable to position said permanent magnet segments to face a member containing said electrostatic latent image on the surface thereof during toning of said electrostatic latent image and being rotatable to a position about 180° removed from said toning position whereby magnetic toner carried on said cylindrical hollow shell is removed from the surface of said cylindrical hollow shell in said toning position.

2. A magnet roll for the toning of electrostatic latent images as disclosed in claim 1, further characterised by said central rectangular core being constructed from magnetisable material.

3. A magnet roll for the toning of electrostatic latent images as disclosed in claim 1, further characterised by said central rectangular core being constructed from non-magnetisable material.

4. A magnet roll for the toning of electrostatic latent images as disclosed in claim 3, further characterised by said central rectangular core constructed from non-magnetisable material having layers of magnetisable material attached to each face thereof other than that face to which face magnetised permanent magnet segments are mounted.

5. A magnet roll for the toning of electrostatic latent images as disclosed in claim 1, further characterised by said non-magnetisabale cylindrical hollow shell comprising an aluminum tube.

6. A magnet roll for the toning of electrostatic latent images as disclosed in claim 1, further characterised by said non-magnetisable cylindrical hollow shell comprising a stainless steel tube.

* * * * *